US007950228B2

(12) United States Patent
Yoon et al.

(10) Patent No.: US 7,950,228 B2
(45) Date of Patent: May 31, 2011

(54) TURBO CHARGE SYSTEM OF AN ENGINE

(75) Inventors: Sung Il Yoon, Seoul (KR); Hyoung-Hyoun Kim, Hwaseong (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 717 days.

(21) Appl. No.: 11/943,833

(22) Filed: Nov. 21, 2007

(65) Prior Publication Data

US 2009/0007565 A1 Jan. 8, 2009

(30) Foreign Application Priority Data

Jul. 6, 2007 (KR) ..... 10-2007-0068140

(51) Int. Cl.

| | |
|---|---|
| ***F02B 33/44*** | (2006.01) |
| ***F02B 37/007*** | (2006.01) |
| ***F02B 33/00*** | (2006.01) |
| ***F01N 1/00*** | (2006.01) |
| ***F01N 3/02*** | (2006.01) |
| ***F01N 7/08*** | (2006.01) |

(52) U.S. Cl. ..... 60/612; 60/323; 60/321; 123/562

(58) Field of Classification Search ..... 60/612, 60/321–323; 123/562; 138/114; 181/277, 181/212, 243, 228, 207; *F02B 37/007*
See application file for complete search history.

(56) References Cited

U.S. PATENT DOCUMENTS

| | | | | |
|---|---|---|---|---|
| 4,538,574 | A * | 9/1985 | Lombardi | 60/612 |
| 4,951,465 | A * | 8/1990 | Torigai | 60/323 |
| 5,331,810 | A * | 7/1994 | Ingermann et al. | 60/323 |
| 5,765,878 | A * | 6/1998 | Bonny et al. | 285/123.1 |
| 6,343,417 | B1 * | 2/2002 | Bonny et al. | 29/890.08 |
| 6,422,222 | B1 * | 7/2002 | Arbeiter et al. | 60/612 |
| 6,523,343 | B2 * | 2/2003 | Durr et al. | 60/323 |
| 6,874,317 | B2 * | 4/2005 | Sugaya et al. | 60/323 |
| 7,347,044 | B1 * | 3/2008 | Lubenow et al. | 60/309 |
| 7,434,656 | B2 * | 10/2008 | Yasuda et al. | 60/321 |
| 2004/0083725 | A1 * | 5/2004 | Loveless et al. | 60/323 |
| 2006/0013746 | A1 * | 1/2006 | Bien et al. | 422/179 |
| 2008/0034752 | A1 * | 2/2008 | Becker et al. | 60/612 |
| 2008/0196409 | A1 * | 8/2008 | Goebelbecker et al. | 60/612 |
| 2008/0203725 | A1 * | 8/2008 | Willeke | 60/322 |
| 2009/0114303 | A1 * | 5/2009 | Kim | 138/121 |
| 2010/0024416 | A1 * | 2/2010 | Gladden et al. | 60/612 |

FOREIGN PATENT DOCUMENTS

| | | | |
|---|---|---|---|
| DE | 19835594 | A1 * | 2/2000 |
| DE | 102004030259 | A1 * | 11/2005 |
| JP | 06336921 | A * | 12/1994 |
| JP | 2586354 | Y2 | 10/1998 |
| JP | 2002-285915 | A | 3/2002 |
| JP | 2006022808 | A * | 1/2006 |

* cited by examiner

*Primary Examiner* — Thai Ba Trieu

(74) *Attorney, Agent, or Firm* — Morgan, Lewis & Bockius LLP

(57) ABSTRACT

A turbo charge system of an engine minimizes energy loss of exhaust gas as a consequence of a crossover pipe that connects exhaust manifolds respectively mounted to cylinder heads at both sides of the engine with each other and that is mounted in each cylinder head, and the crossover pipe is formed as a double pipe structure. The turbo charge system of the engine may include a pair of exhaust manifolds respectively mounted to cylinder heads at both sides of the engine; a pair of turbo chargers connected respectively to the pair of exhaust manifolds and increasing intake air amount by using energy of exhaust gas; and a crossover pipe connecting the pair of exhaust manifolds with each other, wherein a crossover pipe is mounted in each cylinder head.

8 Claims, 5 Drawing Sheets

TURBO CHARGE SYSTEM OF AN ENGINE

CROSS-REFERENCE TO RELATED APPLICATION

This application claims priority to and the benefit of Korean Patent Application No. 10-2007-0068140 filed in the Korean Intellectual Property Office on Jul. 6, 2007, the entire contents of which are incorporated herein by reference.

BACKGROUND OF THE INVENTION (a) Field of the Invention

The present invention relates to a turbo charge system of an engine. More particularly, the present invention relates to a turbo charge system of an engine that minimizes energy loss of exhaust gas by mounting a crossover pipe that connects exhaust manifolds respectively mounted to cylinder heads at both sides of the engine, and the crossover pipe is formed as a double pipe structure.

(b) Description of the Related Art

Generally, an engine must take in as much air mixture as the exhaust gas amount, but it can actually take in only 80% of the exhaust gas amount. The amount of power an engine produces is proportional to the amount of airflow, and the number of valves may be increased or the diameter of the valves may be enlarged in order to increase the air intake amount. In addition, air may be forcibly blown in by a turbo charger in order to increase air intake amount.

Generally, a turbo charge system increases the air intake amount input to an intake manifold by using a turbo charger connected to the intake manifold and an exhaust manifold. More concretely, in a case in which a turbine of the turbo charger is forcibly rotated by exhaust gas having passed through the exhaust manifold, a compressor connected to the turbine rotates and forcibly blows air into the intake manifold. According to the turbo charge system, the high temperature and pressure exhaust gas passes through the turbine and its temperature and pressure are lowered. Therefore, energy of the exhaust gas is transmitted to the turbine and the turbine is rotated. Hence, if the temperature and pressure of the exhaust gas blown into a turbine housing is increased, the turbo charger will have higher efficiency.

According to a conventional turbo charge system for a multi-cylinder-head engine, an intake manifold and an exhaust manifold are mounted at respective sides of each cylinder head, and the exhaust manifolds are respectively connected to first and second turbo chargers. In addition, the first and second turbo chargers are respectively connected to intake manifolds mounted at each cylinder head. Therefore, when exhaust gas is blown into the first and second turbo chargers from the exhaust manifolds, turbines of the first and second turbo chargers rotate. In this case, a compressor connected to each turbine is rotated by rotation of the turbines and forcibly blows air into the intake manifolds. In addition, the exhaust manifolds are connected to each other by a crossover pipe. Therefore, when the engine is operated at a high speed or a high load condition, both the first and second turbo chargers are operated. On the contrary, when the engine is operated at a low speed or a low load condition, the exhaust gas exhausted from one exhaust manifold is gathered at the other exhaust manifold through the crossover pipe, and the gathered exhaust gas rotates the turbine of one turbo charger of the first and second turbo chargers. Thus, efficiency of the turbo charger is improved.

However, since the crossover pipe is mounted at the exterior of the cylinder head according to the conventional turbo charge system, noise may occur and the outward appearance of the cylinder head may be poor. In addition, since the crossover pipe is tightly bent and a length thereof is long, exhaust pressure loss may occur.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a turbo charge system of an engine having advantages of improved exhaust efficiency, reduced noise, and exclusion of an insulator as a consequence of mounting a crossover pipe connecting a pair of exhaust manifolds mounted at respective sides of a cylinder head in the cylinder head.

In addition, the present invention provides a turbo charge system of an engine having further advantages of preventing a cylinder head from receiving heat damage by forming the crossover pipe as a double pipe structure.

A turbo charge system of an engine according to an exemplary embodiment of the present invention may include a pair of exhaust manifolds respectively mounted to cylinder heads at both sides of the engine; a pair of turbo chargers respectively connected to the pair of exhaust manifolds and increasing intake air amount by using energy of exhaust gas; and a crossover pipe connecting the pair of exhaust manifolds with each other, wherein a crossover pipe is mounted in each cylinder head.

The crossover pipe may be formed as a double pipe structure that includes an inner pipe and an outer pipe.

The inner pipe may be disposed apart from the outer pipe by a predetermined distance.

Both ends of the inner pipe may be fixed by expansion rings that are formed at an interior surface of the outer pipe.

One end of the outer pipe may be integrally formed with a gasket.

The inner pipe may be formed as a bellows structure.

At least one air hole may be formed at the outer pipe.

A turbo charge system of an engine according to another exemplary embodiment of the present invention may include a pair of exhaust manifolds respectively mounted to cylinder heads at both sides of the engine; a turbo charger connected to at least one of the pair of exhaust manifolds and increasing intake air amount by using energy of exhaust gas; and a crossover pipe mounted in each cylinder head and connecting the pair of exhaust manifolds with each other, wherein the crossover pipe is formed as a double pipe structure that includes an inner pipe and an outer pipe.

The inner pipe may be disposed apart from the outer pipe by a predetermined distance.

Both ends of the inner pipe may be fixed by expansion rings that are formed at an interior surface of the outer pipe.

One end of the outer pipe may be integrally formed with a gasket.

The inner pipe may be formed as a bellows structure.

At least one air hole may be formed at the outer pipe.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
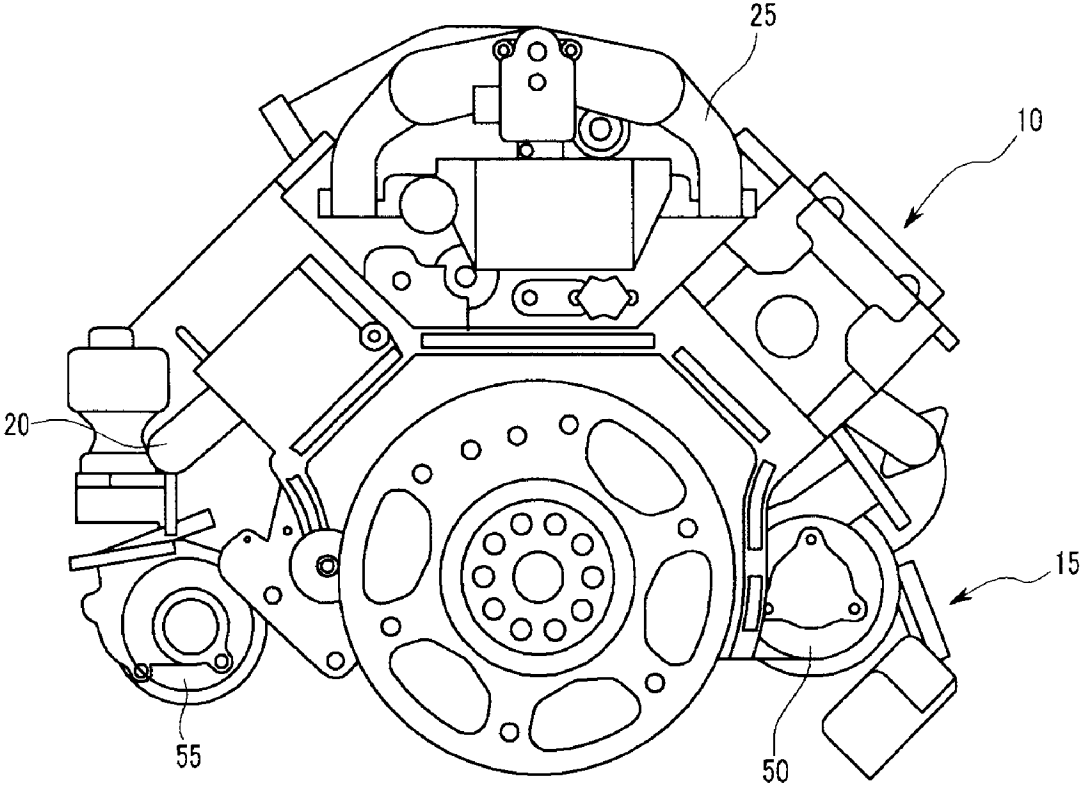
FIG. 1 is a front view of a turbo charge system of an engine according to an exemplary embodiment of the present invention.

It should be understood that the appended drawings are not necessarily to scale, presenting a somewhat simplified representation of various preferred features illustrative of the basic principles of the invention.

The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIG. 1 is a front view of a turbo charge system of an engine according to an exemplary embodiment of the present invention.

As shown in FIG. 1, a turbo charge system according to an exemplary embodiment of the present invention is mounted to an engine. The engine includes cylinder heads 10 and a cylinder block 15.

The engine is provided with intake manifolds 25 at an upper portion thereof and with exhaust manifolds 20 at both sides thereof. Each cylinder head 10 is provided with intake valves and intake cams in order to draw an air mixture into the intake manifold 25, and is provided with exhaust valves and exhaust cams in order to discharge exhaust gas.

Figure 2:
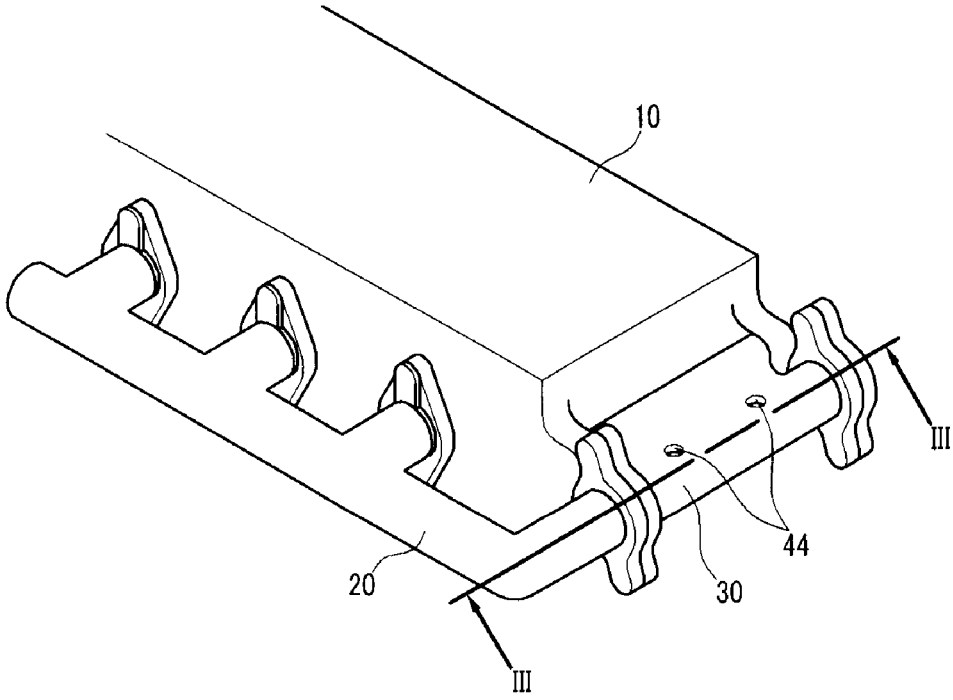
FIG. 2 is a schematic diagram of a crossover pipe mounted in a turbo charge system of an engine according to an exemplary embodiment of the present invention.

In addition, as shown in FIG. 2, the exhaust manifolds 20 mounted at the sides of the cylinder heads 10 are connected with each other through a crossover pipe 30, and a crossover pipe 30 is mounted in each cylinder head 10.

Cylinders (not shown) are formed in the cylinder block 15, and a piston (not shown) is mounted in each cylinder. The pistons move reciprocally by the explosive force of an air/fuel mixture. In addition, a crankshaft (not shown) that is rotated by the reciprocal motion of the pistons is mounted in the cylinder block 15, and a connecting rod connects each piston with the crankshaft. A coolant pathway in which coolant flows is formed in the cylinder block 15. In addition, first and second turbo chargers 50 and 55 are mounted at both sides of the engine and are respectively connected to a pair of exhaust manifolds 20. Two turbo chargers 50 and 55 are used in the turbo charge system of the engine according to an exemplary embodiment of the present invention, but only one turbo charger may be used. In that case, one exhaust manifold 20 of the pair of exhaust manifolds 20 is connected to the turbo charger 50 and the exhaust gas is discharged to the turbo charger 50 from the one exhaust manifold 20. In addition, the other exhaust manifold 20 discharges the exhaust gas to the one exhaust manifold 20 through the crossover pipe 30.

The first and second turbo chargers 50 and 55 are respectively connected to the pair of exhaust manifolds 20, and turbines of the first and second turbo chargers 50 and 55 are rotated by the exhaust gas discharged from the exhaust manifolds 20. In addition, the first and second turbo chargers 50 and 55 are respectively connected to the pair of intake manifolds 25, and forcibly blow air into the pair of intake manifolds 25.

The turbo charge system of the engine according to an exemplary embodiment of the present invention may be 2-step turbo charge system which is selectable. That is, in a low speed condition or a low load condition, exhaust gas is discharged to one turbo charger 50 between the first and second turbo chargers 50 and 55. On the contrary, in a high speed condition or a high load condition, the exhaust gas is discharged to both the first and second turbo chargers 50 and 55.

Hereinafter, referring to FIG. 2 to FIG. 5, a connection between the exhaust manifold and the crossover pipe in the turbo charge system of the engine according to an exemplary embodiment of the present invention will be described in detail.

Figure 3:
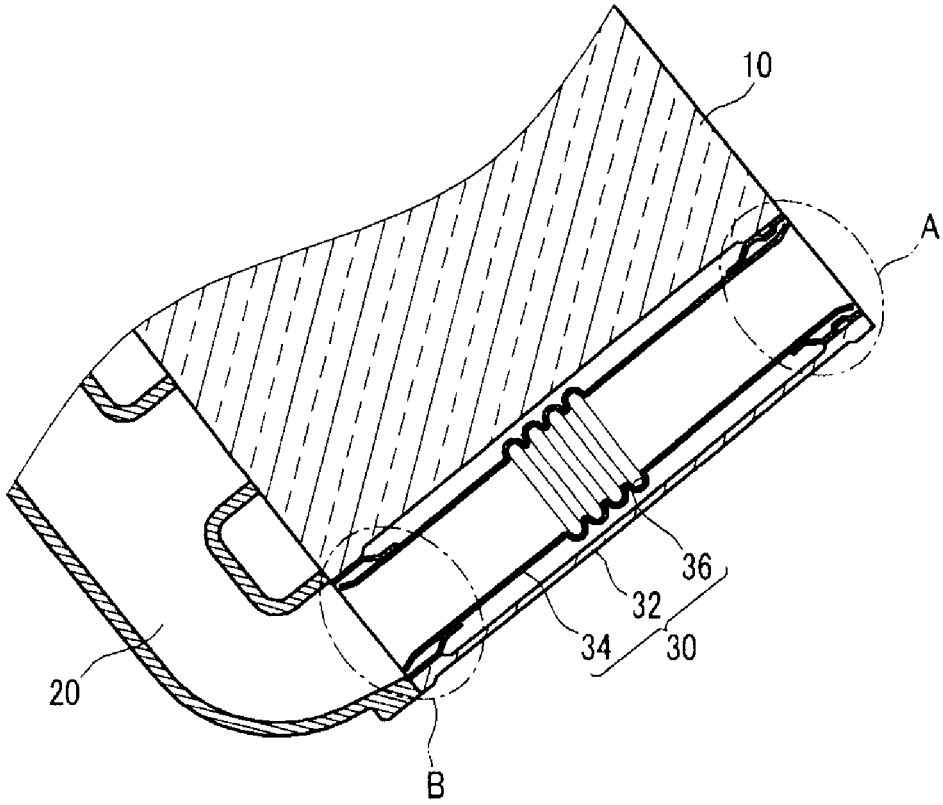
FIG. 3 is a cross-sectional view of FIG. 2 taken along the line III-III.
Figure 4:
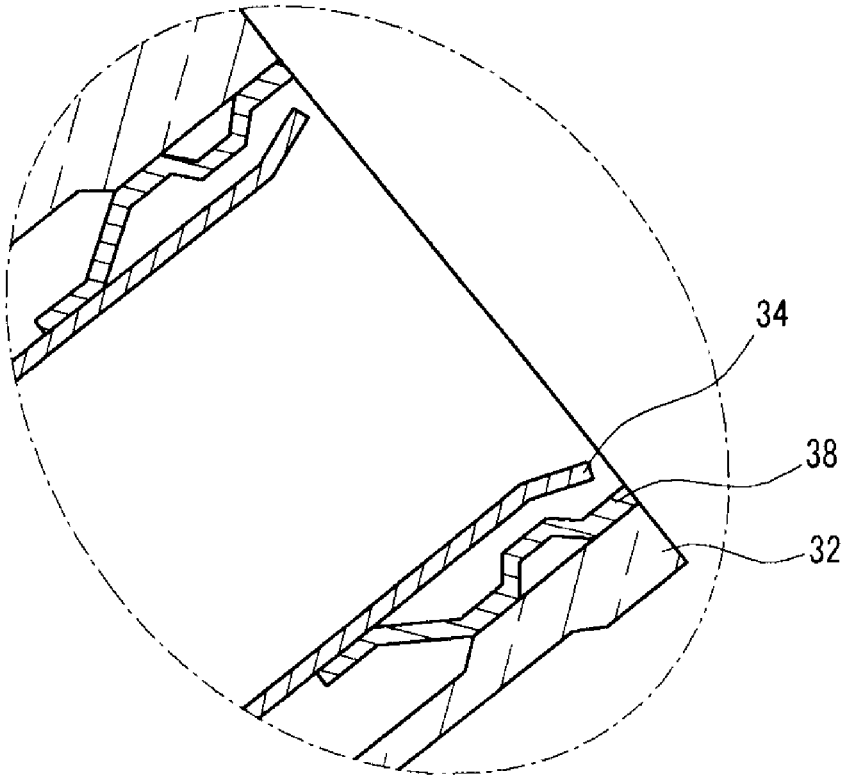
FIG. 4 is an enlarged view of the "A" section of the crossover pipe shown in FIG. 3.
Figure 5:
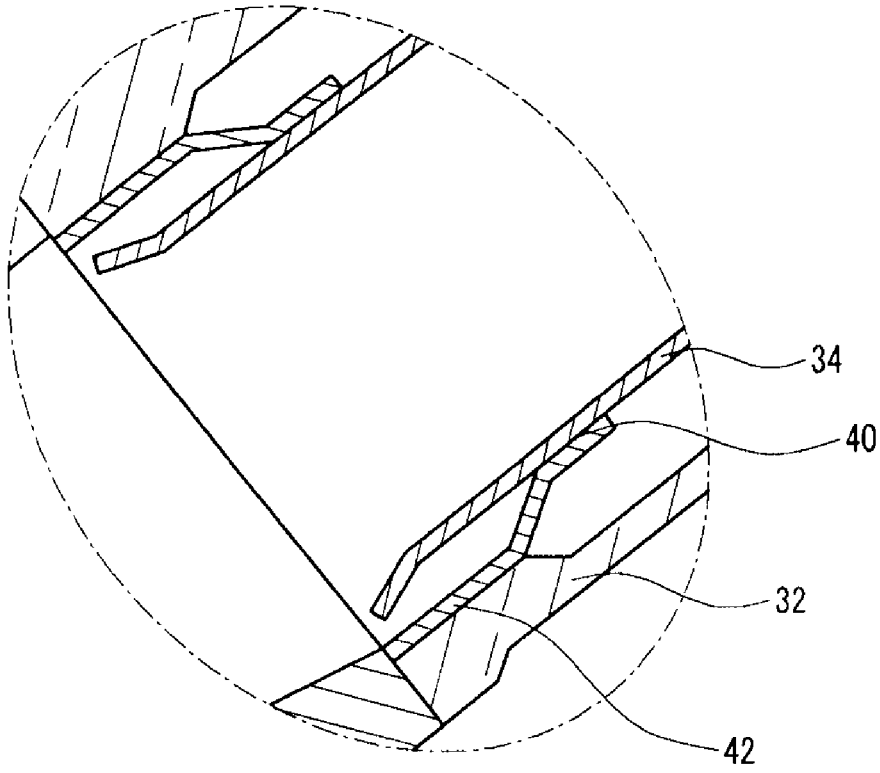
FIG. 5 is an enlarged view of the "B" section of the crossover pipe shown in FIG. 3.

FIG. 2 is a schematic diagram of a crossover pipe mounted in a turbo charge system of an engine according to an exemplary embodiment of the present invention, FIG. 3 is a cross-sectional view of FIG. 2 taken along the line III-III, FIG. 4 is an enlarged view of the "A" section of the crossover pipe shown in FIG. 3, and FIG. 5 is an enlarged view of the "B" section of the crossover pipe shown in FIG. 3.

As shown in FIG. 2 and FIG. 3, the pair of exhaust manifolds 20 mounted at both sides of the engine are connected with each other through the crossover pipes 30, and a crossover pipe 30 is mounted in each cylinder head 10. Therefore, the length of each crossover pipe 30 may be shortened and exhaust loss may be reduced. In addition, appearance of the engine may be good.

The crossover pipe 30 is formed as a double pipe structure where an inner pipe 34 is mounted in an outer pipe 32. Since the temperature of the exhaust gas is generally 750-800° C., durability of the cylinder head 10 is deteriorated by heat of the exhaust gas when the crossover pipe 30 is mounted in the cylinder head 10. Therefore, the crossover pipe 30 is formed as the double pipe structure in order to prevent the cylinder head 10 from suffering from heat damage.

In addition, the inner pipe 34 is disposed apart from the outer pipe 32 by a predetermined distance in order to prevent the cylinder head 10 from suffering from the heat damage caused by the high temperature exhaust gas passing through the inner pipe 34.

The inner pipe 34 is formed as a bellows structure 36 in order to not be broken by the heat of the exhaust gas. In addition, at least an air hole 44 is formed at the crossover pipe 30 in order to emit heat of the exhaust gas. Air holes 44 may be formed at upper and lower portions of the crossover pipe 30, and are preferably located at corresponding positions.

As shown in FIG. 4 and FIG. 5, both ends of the inner pipe 34 are fixed by expansion rings 38 and 40 extending inwards from an interior surface of the distal ends of the outer pipe 32 respectively to internal portions of the outer surface of the inner pipe. As shown in FIG. 5, one distal end of the outer pipe 32 connected to one end of the exhaust manifold 20 is integrally formed with a gasket 42 thereon in order to prevent the exhaust gas coming from the exhaust manifold 20 from leaking in the outer pipe 32 through a gap between the outer pipe 32 and the inner pipe 34. The outer pipe 32 and the gasket 42 may be made of the same material. In addition, the gasket 42 may be integrally formed with an distal end of the expansion ring 40.

According to the present invention, the overall length of a crossover pipe may be shortened, and exhaust loss and noise may be reduced since a crossover pipe is mounted in a cylinder head. In addition, exhaust efficiency may be improved and appearance may be good since an insulator can be removed.

Further, a cylinder head may be prevented from suffering from heat damage since a crossover pipe is formed as a double pipe structure including an inner pipe and an outer pipe and the inner pipe is disposed apart from the outer pipe by a predetermined distance.

Since an inner pipe that directly contacts exhaust gas is formed as a bellows structure, the inner pipe may be prevented from being broken by heat of the exhaust gas The forgoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiment were chosen and described in order to explain certain principles of the invention and their practical application, to thereby enable others skilled in the art to make and utilize various exemplary embodiments of the present invention, as well as various alternatives and modifications thereof. It is intended that technical spirit and scope of the present invention be defined by the Claims appended hereto and their equivalents.

What is claimed is:

1. A turbo charge system of an engine, comprising:

a pair of exhaust manifolds respectively mounted to cylinder heads at both sides of the engine;

a pair of turbo chargers respectively connected to the pair of exhaust manifolds and increasing intake air amount by using energy of exhaust gas; and a crossover pipe connecting the pair of exhaust manifolds with each other;

wherein the crossover pipe is mounted in each cylinder head;

wherein the crossover pipe is formed as a double pipe structure comprising an inner pipe and an outer pipe;

wherein both ends of the inner pipe are fixed by expansion rings that are formed between the inner pipe and the outer pipe wherein a first end of the expansion ring is positioned at a distal end of an interior surface of the outer pipe and a second end of the expansion ring contacts at least an internal portion of the outer surface of the inner pipe; and wherein a distal end of the outer pipe is integrally formed with a gasket protruding toward the expansion ring and contacts the first end of the expansion.

2. The turbo charge system of claim 1, wherein the inner pipe is disposed in the outer pipe and offset apart from the inner surface of the outer pipe by a predetermined distance.

3. The turbo charge system of claim 1, wherein at least a portion of the inner pipe is formed as a bellows structure.

4. The turbo charge system of claim 3, wherein at least an air hole is formed at the outer pipe.

5. A turbo charge system of an engine, comprising:

a pair of exhaust manifolds respectively mounted to cylinder heads at both sides of the engine;

a turbo charger connected to at least one of the pair of exhaust manifolds and increasing intake air amount by using energy of exhaust gas; and a crossover pipe mounted in each cylinder head and connecting the pair of exhaust manifolds with each other;

wherein the crossover pipe is formed as a double pipe structure that comprises an inner pipe and an outer pipe;

wherein at least a portion of the inner pipe is formed as a bellows structure; and wherein at least one air hole is formed at the outer pipe of the crossover pipe.

6. The turbo charge system of claim 5, wherein the inner pipe is disposed in the outer pipe and offset apart from the outer pipe by a predetermined distance.

7. The turbo charge system of claim 6, wherein both ends of the inner pipe are fixed by expansion rings that are formed between the inner pipe and the outer pipe wherein a first end of the expansion ring is positioned at a distal end of an interior surface of the outer pipe and a second end of the expansion ring contacts at least an internal portion of the outer surface of the inner pipe.

8. The turbo charge system of claim 7, wherein one end of the outer pipe is integrally formed with a gasket protruding toward the expansion ring and contacts the first end of the expansion ring.

* * * * *